US008066623B2

(12) United States Patent
Tokuma

(10) Patent No.: US 8,066,623 B2
(45) Date of Patent: Nov. 29, 2011

(54) IN-WATER TRAINING AND REHABILITATION DEVICE

(76) Inventor: Hidetaka Tokuma, Abiko (JP)

( * ) Notice: Subject to any disclaimer, the term of this patent is extended or adjusted under 35 U.S.C. 154(b) by 0 days.

(21) Appl. No.: 11/884,756

(22) PCT Filed: Feb. 21, 2006

(86) PCT No.: PCT/JP2006/003018

§ 371 (c)(1),
(2), (4) Date: Aug. 21, 2007

(87) PCT Pub. No.: WO2006/088196

PCT Pub. Date: Aug. 24, 2006

(65) Prior Publication Data

US 2008/0132390 A1 Jun. 5, 2008

(30) Foreign Application Priority Data

Feb. 21, 2005 (JP) ..... 2005-043469

(51) Int. Cl.
*A63B 21/008* (2006.01)

(52) U.S. Cl. ..... 482/111; 441/56

(58) Field of Classification Search ..... 482/109, 482/111, 906, 55, 148, 908; 441/56, 58, 441/57, 55, 59, 60, 61, 62, 63, 64; D12/215; 440/21, 101, 102; 473/228, 463; 273/DIG. 30, 273/265, 271; 446/48, 66; D21/678; 434/128
See application file for complete search history.

(56) References Cited

U.S. PATENT DOCUMENTS

| | | | | | |
|---|---|---|---|---|---|
| 802,306 | A | * | 10/1905 | McKittrick | 441/61 |
| 1,677,888 | A | * | 7/1928 | Connors | 416/71 |
| 3,604,706 | A | * | 9/1971 | Baukney | 473/554 |
| 3,765,042 | A | * | 10/1973 | Montrella | 441/58 |
| 3,820,785 | A | * | 6/1974 | Occhipinti et al. | 473/463 |
| 4,052,755 | A | * | 10/1977 | Baker | 4/497 |
| 4,138,120 | A | * | 2/1979 | Daitzman | 273/271 |
| 4,203,597 | A | * | 5/1980 | Reedhead et al. | 473/534 |

(Continued)

FOREIGN PATENT DOCUMENTS

JP U-55-056672 4/1980

(Continued)

OTHER PUBLICATIONS

Oct. 5, 2010 Office Action issued in corresponding Japanese Patent Application No. JP 2007-503778 (with English Translation).

*Primary Examiner* — Loan Thanh
*Assistant Examiner* — Daniel F Roland
(74) *Attorney, Agent, or Firm* — Oliff & Berridge, PLC

(57) ABSTRACT

An in-water training and rehabilitation device capable of individually training and rehabilitating an objective muscle of forearms at home with ease is provided. The in-water training and rehabilitation device according to the present invention is an in-water training device 10 that is held with a hand and moved in water for the purpose of strengthening a desired muscle of, mainly, forearms, and includes a substantially planar resistance part 14 whose area is variable and a plurality of handles 13 of different kinds. In the present invention, the plurality of handles 13 of different kinds may be constantly fixed to the resistance part 14 as in (d) or may be adapted to be replaceable as appropriate through an attaching and removing mechanism.

14 Claims, 6 Drawing Sheets

U.S. PATENT DOCUMENTS

| | | | | | |
|---|---|---|---|---|---|
| 4,243,227 | A | * | 1/1981 | Strongin | 273/357 |
| 4,381,112 | A | * | 4/1983 | Dupuy | 273/239 |
| 4,416,451 | A | * | 11/1983 | Solloway | 482/111 |
| D276,447 | S | * | 11/1984 | Escamilla-Kelly | D21/337 |
| 4,480,829 | A | * | 11/1984 | Yacoboski | 482/111 |
| D279,919 | S | * | 7/1985 | Bedgood | D21/678 |
| 4,576,378 | A | * | 3/1986 | Backus | 473/228 |
| 4,607,847 | A | * | 8/1986 | Chung | 273/264 |
| 4,627,613 | A | * | 12/1986 | Solloway | 482/111 |
| 4,651,996 | A | * | 3/1987 | Watkins, Jr. | 273/271 |
| 4,685,667 | A | * | 8/1987 | McDonald | 482/111 |
| 4,913,418 | A | * | 4/1990 | Schlueter et al. | 482/55 |
| 5,041,037 | A | * | 8/1991 | Jaw | 440/102 |
| 5,147,233 | A | * | 9/1992 | Hannula | 441/56 |
| 5,157,854 | A | * | 10/1992 | Rumsey, Jr. | 43/12 |
| 5,186,699 | A | * | 2/1993 | Dimmig | 482/111 |
| 5,362,059 | A | * | 11/1994 | Grossman | 473/228 |
| 5,378,217 | A | * | 1/1995 | D'Orta | 482/111 |
| 5,441,044 | A | * | 8/1995 | Tovey et al. | 600/234 |
| 5,460,589 | A | * | 10/1995 | Dunn | 482/111 |
| 5,472,394 | A | * | 12/1995 | Michaelson | 482/74 |
| 5,482,434 | A | * | 1/1996 | Heaven | 416/70 R |
| 5,490,823 | A | * | 2/1996 | Awbrey et al. | 482/55 |
| 5,529,550 | A | * | 6/1996 | Maycock et al. | 482/44 |
| 5,531,657 | A | * | 7/1996 | Macedo | 482/111 |
| 5,533,950 | A | * | 7/1996 | Lochbaum | 482/51 |
| 5,571,048 | A | * | 11/1996 | Kenney | 473/228 |
| 5,577,730 | A | * | 11/1996 | Vannozzi, Sr. | 273/260 |
| 5,611,763 | A | * | 3/1997 | Lochbaum | 482/111 |
| 5,643,154 | A | * | 7/1997 | Awbrey et al. | 482/111 |
| 5,766,116 | A | * | 6/1998 | Weissbuch | 482/111 |
| 5,769,763 | A | * | 6/1998 | Lochbaum | 482/111 |
| 5,795,273 | A | * | 8/1998 | Lochbaum | 482/111 |
| 5,842,896 | A | * | 12/1998 | Liveoak | 441/56 |
| 6,050,925 | A | * | 4/2000 | Irvin et al. | 482/111 |
| D450,093 | S | * | 11/2001 | Elliott et al. | D21/335 |
| D450,351 | S | * | 11/2001 | Fong | D21/335 |
| 6,315,700 | B1 | * | 11/2001 | Shifferaw | 482/111 |
| 6,322,485 | B1 | * | 11/2001 | Marrero | 482/140 |
| 6,325,727 | B1 | * | 12/2001 | Carr | 473/228 |
| 6,428,003 | B1 | * | 8/2002 | Fondin et al. | 273/241 |
| 6,513,708 | B2 | * | 2/2003 | Evans | 235/64 |
| 6,533,277 | B1 | * | 3/2003 | Yin | 273/153 R |
| 6,655,687 | B2 | * | 12/2003 | Sanchez-Seco | 273/271 |
| 7,044,819 | B1 | * | 5/2006 | Dulemba | 441/58 |
| 7,125,340 | B1 | * | 10/2006 | Priester et al. | 473/228 |
| 7,128,698 | B2 | * | 10/2006 | Shifferaw | 482/111 |
| D535,703 | S | * | 1/2007 | Creech | D21/335 |
| 7,179,146 | B2 | * | 2/2007 | Johnson | 441/56 |
| 7,211,032 | B2 | * | 5/2007 | Shifferaw | 482/111 |
| 7,810,814 | B1 | * | 10/2010 | Chapman et al. | 273/271 |
| 2002/0132708 | A1 | * | 9/2002 | Spooner et al. | 482/55 |
| 2004/0197754 | A1 | * | 10/2004 | Coppelli | 434/254 |
| 2006/0116258 | A1 | * | 6/2006 | Shifferaw | 482/111 |
| 2006/0128534 | A1 | * | 6/2006 | Roque | 482/82 |
| 2006/0175755 | A1 | * | 8/2006 | Benedict | 273/271 |
| 2008/0299522 | A1 | * | 12/2008 | Weber | 434/128 |
| 2010/0056000 | A1 | * | 3/2010 | Kang | 440/101 |

FOREIGN PATENT DOCUMENTS

| | | |
|---|---|---|
| JP | U-59-133277 | 9/1984 |
| JP | A-61-048387 | 3/1986 |
| JP | U-03-118766 | 12/1991 |
| JP | U-3032020 | 9/1996 |
| JP | A-08-318006 | 12/1996 |
| JP | A-2001-346855 | 12/2001 |

* cited by examiner

IN-WATER TRAINING AND REHABILITATION DEVICE

TECHNICAL FIELD

The present invention relates to an in-water training and rehabilitation device for individually developing or rehabilitating muscles of, mainly, forearms and lower part of the body.

BACKGROUND ART

In almost all sports using a hand or hands, muscles of forearms (musculus brachioradialis, flexor carpi radialis muscles, long palmar muscles, flexor digitorum superficialis muscles, flexor carpi ulnaris muscles, extensor carpi radialis longus muscles, extensor carpi radialis brevis, and common digital extensor muscles) play critical roles, and it is inevitable to develop pertinent muscles individually in accordance with the purpose in order to improve one's skills in an objective sport. It is well known that developing muscles of the lower part of the body is also quite effective means for most sports.

The only method of developing muscles is so-called strength training of expanding and contracting muscles against loads or resistance. Most of conventional strength training activities typically practiced have no clear purpose. Some of the training activities use a special tool under the guidance of a professional trainer, but a trainee needs to go to special facilities to perform such training activities.

Various tools for easily performing strength training at home have been conventionally proposed, but any of them has no clear purpose as described above and most of them just give temporary ease of mind. For example, Patent Document 1 discloses a tool that is held in a hand and moved in water against resistance for developing muscles of arms. This tool includes a plurality of resistance plates and has an advantage that it can vary the resistance in water by adjusting the manner in which these resistance plates are superimposed on each other.

[Patent Document 1] Japanese Unexamined Utility Model Registration Application Publication No. H3-118766.

DISCLOSURE OF THE INVENTION

Problem to be Solved by the Invention

However, the tool described in Patent Document 1 is intended to just move the hand against the water resistance, and thus fails to perform such complicated training as is intended for special muscle improvement. Moreover, the tool described in Patent Document 1 is mainly targeted for muscles of the entire upper body, including muscles of upper arms, the back, and the like, and suffers from difficulties in individually strengthening individual muscles.

The present invention is intended to provide a training and rehabilitation device capable of individually developing muscles of forearms, i.e., critical muscles used in common among various sports and also synthetically developing muscles of the lower body at home without difficulty in accordance with the power level of an individual irrespective of age and sex. The present invention, in the event of deterioration in capabilities of these muscles due to sports disorders, aging, or the like, can also be effectively used for rehabilitation for restoring these muscles.

Means for Solving the Problems

The present invention made to solve the problem described above refers to an in-water training and rehabilitation device that is held with a hand and moved in water for developing or rehabilitating a desired muscle of mainly forearms. The in-water training and rehabilitation device includes: a substantially planar resistance part whose area is variable; and a plurality of handles of different kinds.

In the present invention, the plurality of handles of different kinds may be constantly fixed or may be adapted to be replaceable as appropriate through an attaching and removing mechanism.

Another aspect of the present invention refers to an in-water walking training and rehabilitation device for exercising by walking in water, which includes: a substantially planar resistance part whose area is variable; and a connecting line for connecting the resistance part to an exerciser.

It is preferable that the resistance part be equipped with buoyancy adjusting means.

Effect of the Invention

An in-water training and rehabilitation device according to the present invention includes a planar resistance part, and by moving this against resistance in the water, one can perform training for developing or rehabilitating muscles. In the in-water training and rehabilitation device of the present invention, the area of this resistance part is variable, so that load of movement in water can be varied, thereby permitting performing program training such as step-up training or the like. Moreover, even people who conventionally could not perform training or rehabilitation, such as elderly people with reduced muscle strength and people in rest or under treatment due to some circumstance (for example, brain infarction, bone fracture, or the like), can set load in accordance with their own levels and perform training/rehabilitation safely in every bathing at home. This can effectively prevent disuse atrophy (atrophy of unused muscles or deteriorating mobility of joints not moved) that was often observed in these people who gave up exercise.

The in-water training and rehabilitation device according to the present invention further includes a plurality of handles of different kinds, so that a desired muscle of forearms can be trained by varying the way in which the handle is held with a hand. Consequently, the in-water training and rehabilitation device can be applied to an exercise that involves the same movement as that of the wrist in any of sports (and additionally in playing some musical instrument as described later and the like). Moreover, a muscle functionally deteriorated can be rehabilitated to recover the function thereof. Further, considering this device as a rehabilitation device, due to the provision of three kinds of handles including a bar handle, a grip handle, and a palm-fixing handle, the user can select the reasonable handle that gives the least feeling of pain to him or her. For example, a person who cannot open the palm can use the bar handle. A person who cannot successfully grasp the bar grip can use the open-palm inserting handle. This permits rehabilitation for those who gave up rehabilitation.

Advantages offered by rehabilitation during bathing include: a point that joints and muscles are released from ordinary strain, which facilitates movement of a person with pain, thus leading, in combination with heat-induced blood circulation improvement, to treatment of pain or paralysis; a point that movable ranges of joints or muscles are widened; a point that physical and mental stress can be released; and the like.

Adapting the area of the resistance part to be variable asymmetrically with respect to one of the handles facilitates training and rehabilitation intended for further individual muscle improvements.

On the other hand, an in-water walking training and rehabilitation device according to the present invention includes a substantially planar resistance part whose area is variable and a connecting line for connecting the resistance part to an exerciser, so that in-water walking against resistance can be performed in accordance with the stage of training or rehabilitation, which in turn permits reliable execution of a training/rehabilitation program provided by a trainer or a doctor. In addition, by providing buoyancy adjusting means in the resistance part, a muscle to be trained or rehabilitated can be selected, thus further improving a training/rehabilitation effect.

EMBODIMENT

Figure 1:
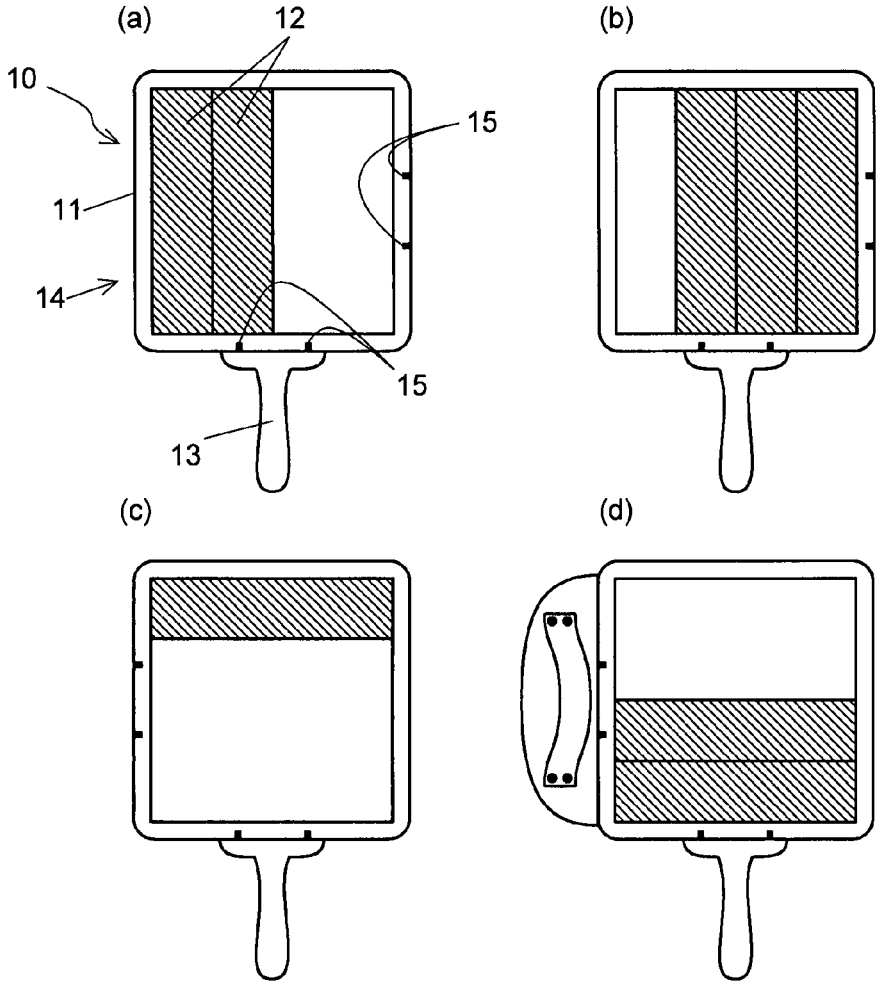
FIG. 1 An elevation view showing various forms of usage of an in-water training and rehabilitation device of one embodiment of the present invention.

A first embodiment of the present invention will be described, referring to FIG. 1. The in-water training and rehabilitation device 10 of the present embodiment is configured so that an elongated resistance plate 12 is freely attached in a substantially square frame 11. FIG. 1(*a*) shows an example of the resistance plate 12 attached to only the left portion, FIG. 1(*b*) shows an example of the resistance plate 12 attached to only a right portion, FIG. 1(*c*) shows an example of the resistance plate 12 attached to only an upper portion (distant from the wrist), and FIG. 1(*d*) shows an example of the resistance plate 12 attached to only a lower portion (closer to the wrist). As is shown in these drawings, the number of resistance plates 12 used may be any of one to four (all surfaces blocked, not shown) in accordance with the purpose and stage of training or rehabilitation. Portions of the frame 11 and the resistance plate 12 are collectively called a resistance part 14.

In two adjacent sides of the frame 11, fixing holes 15 are provided for allowing attaching of a handle 13 therein. In the fixing holes 15, projections 21 (FIG. 2(*a*)) of the handle 13 are inserted and fixed, thereby the in-water training and rehabilitation device 10 can be held in hand.

Figure 2:
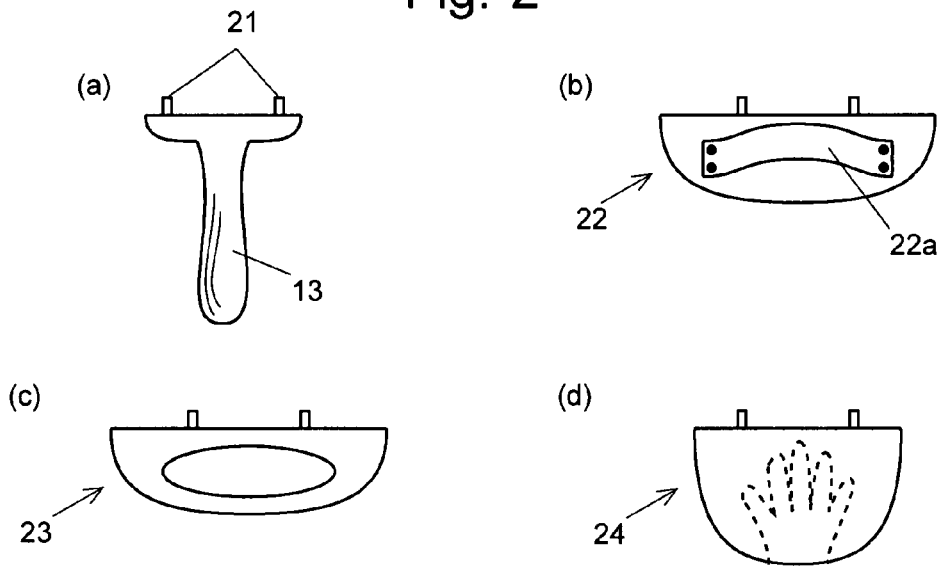
FIG. 2 An elevation view of various handles.

FIG. 2(*a*) shows the handle 13 used in the embodiment of FIG. 1. Other possible handles used include various forms of handles, such as a band handle (22) with palm inserted and then fixed with a rubber band 22*a* as shown in FIG. 2(*b*), a grip handle (23) gripped with the hand as shown in FIG. 2(*c*), a grove handle (24) used with five fingers inserted as shown in FIG. 2(*d*), and the like.

The stick handle 13 of FIG. 2(*a*) is suitable for use in developing musculus brachioradialis mainly used in sports that involve movement of vertically grasping some bar-like member or grip of something and then swinging it or hitting something. Examples of such sports include: kendo, fencing, tennis, golf, badminton, table tennis, hockey, band twirling, baseball, lacrosse, gate ball, and the like. The stick handle 13 is also suitable for an exercise for playing the percussion instruments such as drums, although this is not a sport.

The band handle 22 of FIG. 2(*b*) is suitable for developing flexor carpi ulnaris muscles or long palmar muscles mainly used in sports that involve movement of throwing a ball or the like. Examples of such sports include: baseball, volleyball (spiking), basketball (shooting), rugby, swimming, surfing (paddling), bowling, and the like.

The grip handle 23 of FIG. 2(*c*) is suitable for developing flexor digitorum superficialis muscles or long palmar muscles mainly used in sports that involve movement of horizontally grasping a bar-like member or a handle and then rolling it, twisting it, beat it in, or pulling it in. Examples of such sports include: judo, karate, boxing, windsurfing, horse riding, American football, arm wrestling, wrestling, and the like.

The grove handle 24 of FIG. 2(*d*) is suitable for training in sports that involve movement requiring delicate control based on the palm orientation. With this handle 24, muscles can be trained freely in accordance with the purpose through intentional delicate control of the movement of the in-water training and rehabilitation device 10.

Any of these handles 13 and 22 to 24 that is provided in the form in accordance with the purpose may be attached upon every use of the in-water training and rehabilitation device 10, or two (or more) of these handles as shown in FIG. 1(*d*) may be attached at the same time to the resistance part 14 so that any of them may be used in accordance with need.

Figure 3:
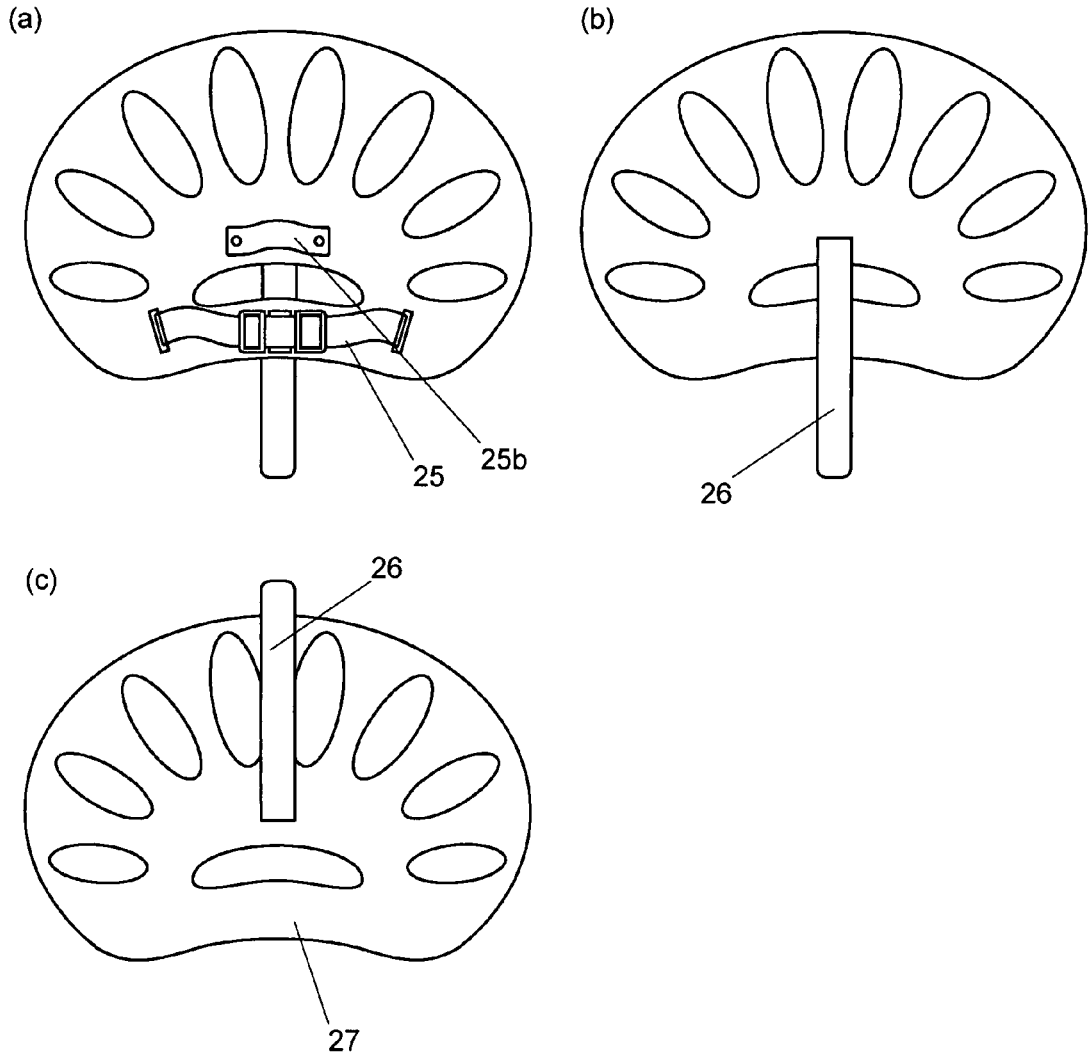
FIG. 3 An elevation view of another in-water training and rehabilitation device (a), a back view thereof (b), and a back view thereof with the handle inverted (c).

As shown in FIG. 3, three types of handles including a band handle 25, a stick handle 26, and a grip handle 27 can also be attached at the same time. In this example, upon use of the band handle 25, a middle finger band 25*b* for inserting a middle finger is used at the same time. Upon use of the grip handle 27, the stick handle 26 can be folded so that it does not serve as an obstacle.

Figure 4:
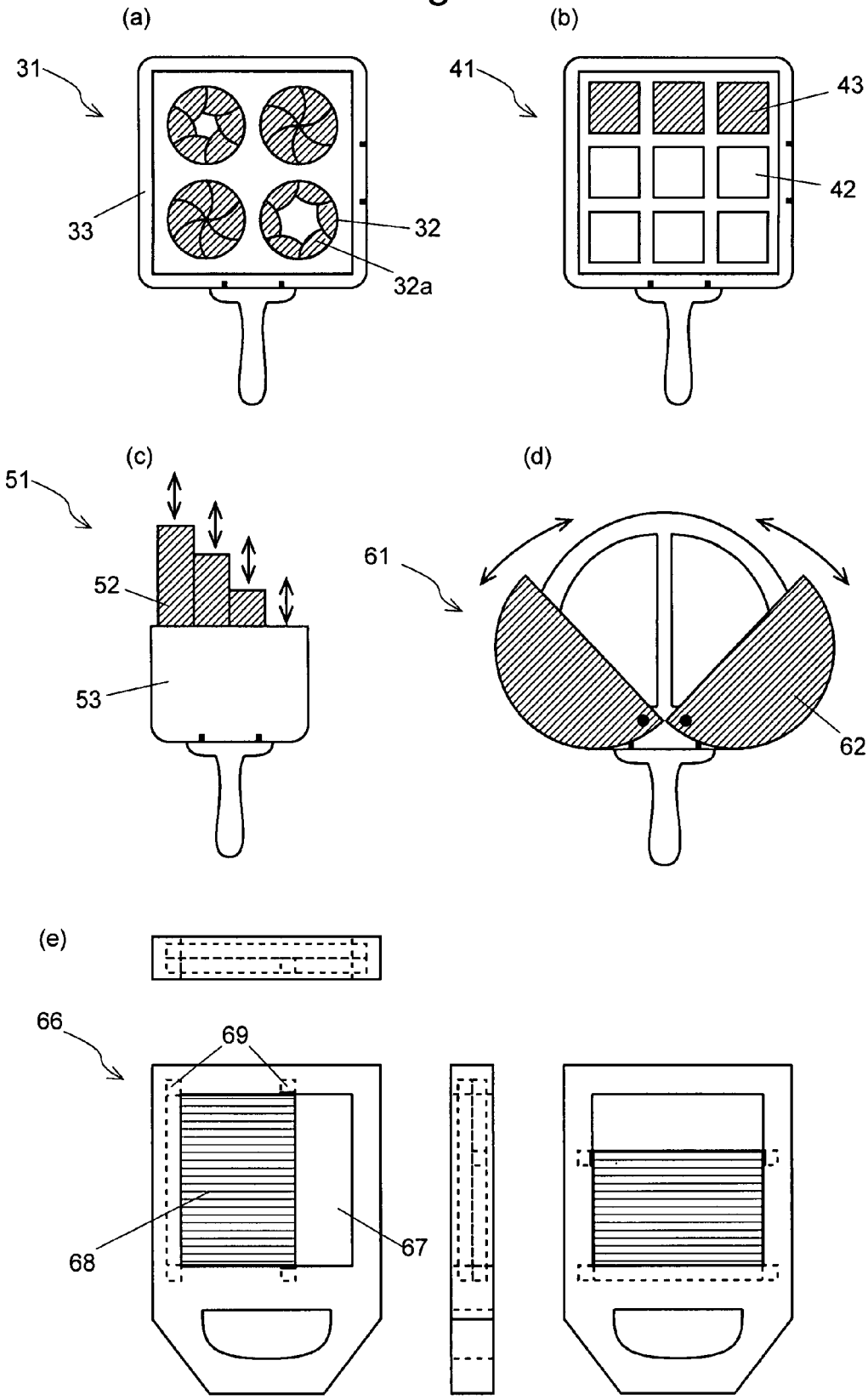
FIG. 4 An elevation view of other various types of in-water training and rehabilitation devices.
Figure 5:
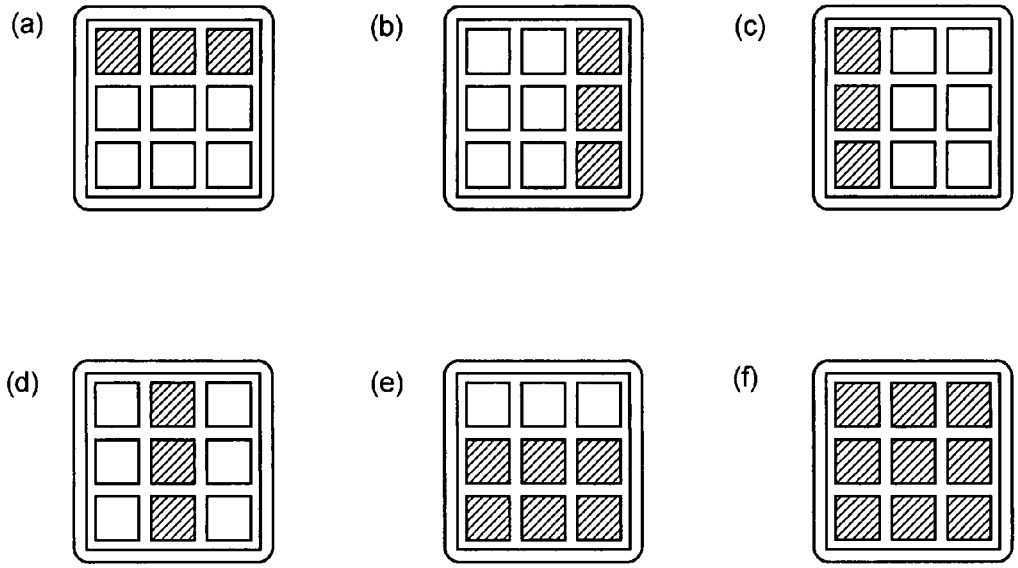
FIG. 5 An elevation view showing the ways in which various resistance plates of the in-water training and rehabilitation device of FIG. 4(*b*) are fitted.
Figure 6:
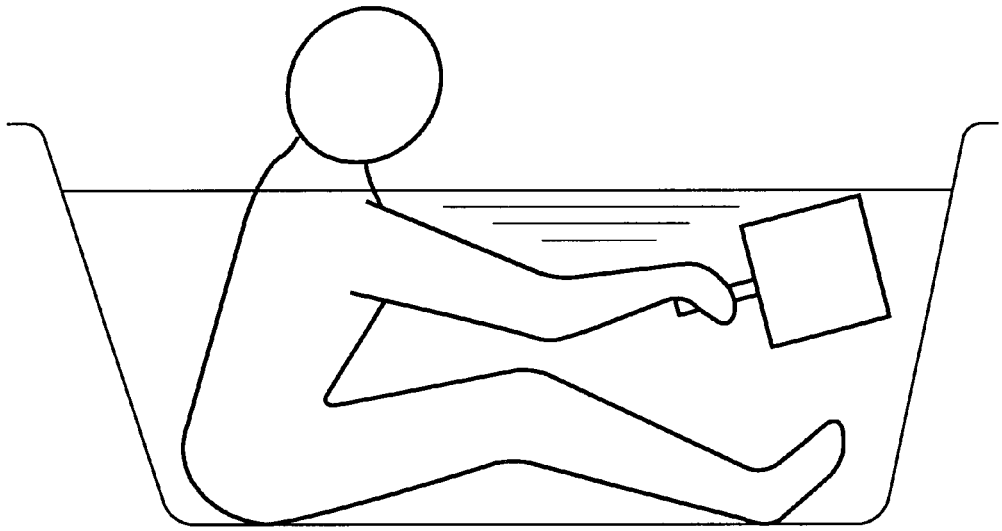
FIG. 6 A sectional view showing one example of usage of the in-water training and rehabilitation device of the present invention.

FIG. 4 shows other various examples of the resistance part. FIG. 4(*a*) refers to the resistance part (31) where a plurality of resistance plates 32 capable of varying the size of an opening with a plurality of blades 32*a* that moves like an aperture stop of a camera shutter are arranged in a frame 33. FIG. 4(*b*) refers to the plate part (41) where resistance plates 43 are inserted in square holes 42 provided in three rows and three columns to thereby adjust overall resistance. As shown in FIG. 5, this resistance plate 41 can create a large variation in resistance distribution. With the distribution in FIG. 5(*a*), flexor and extensor muscles on the wrist side can be mainly developed. With distribution in FIG. 5(*b*), where resistance is applied mainly to the right side, musculus brachioradialis can be mainly developed. With the distribution in FIG. 5(*c*), where resistance is, on the other hand, applied to the left side, longer palmar muscles can be developed. With distribution in FIG. 5(*d*), where resistance is applied to the center, longer palmar muscles, flexor carpi radialis muscles, and musculus brachioradialis can be developed at the same time. With distribution in FIG. 5(*e*), longer palmar muscles and flexor carpi radialis muscles on the elbow side can be mainly developed.

With distribution in FIG. 5(*f*), where the resistance plates 43 are included all over the surface, entire muscles of forearms can be developed.

Returning to FIG. 4, FIG. 4(*c*) refers to the resistance part 51 where resistance plates 52 like fingers are taken out from and pulled in a board 53 side to thereby vary resistance and which can voluntarily develop mainly flexor carpi ulnaris muscles of left and right forearms. The resistance plate 52 can be taken out from and pulled in the board 53 through click stop (stepping motion) in a stepwise fashion. FIG. 4(*d*) refers to the resistance part (61) where resistance plates 62 can open to the left and right and which can also voluntarily develop musculus brachioradialis and flexor carpi ulnaris muscles of left and right forearms. Desirably, this can also adjust the degree of opening through a click stop (stepping motion). FIG. 4 (*e*) refers to the resistance plate (66) where two sticks 69 having cloth 68 stretched in a window 67 are mounted and whose area can be varied by winding the cloth 68 around one of the sticks 69 or unwinding from the stick 69. As shown in an elevation and a back views of the same figure, the two sticks 69 having the cloth 68 stretched can be attached horizontally at the front and vertically at the back for area adjustment.

Each of the in-water training and rehabilitation devices described above is used in a manner such that it is held with a hand in accordance with the form of the handle and then moved in water vertically to the surface. Repeating this movement many times permits development of the muscles described above in accordance with the form of the resistance.

Figure 7:
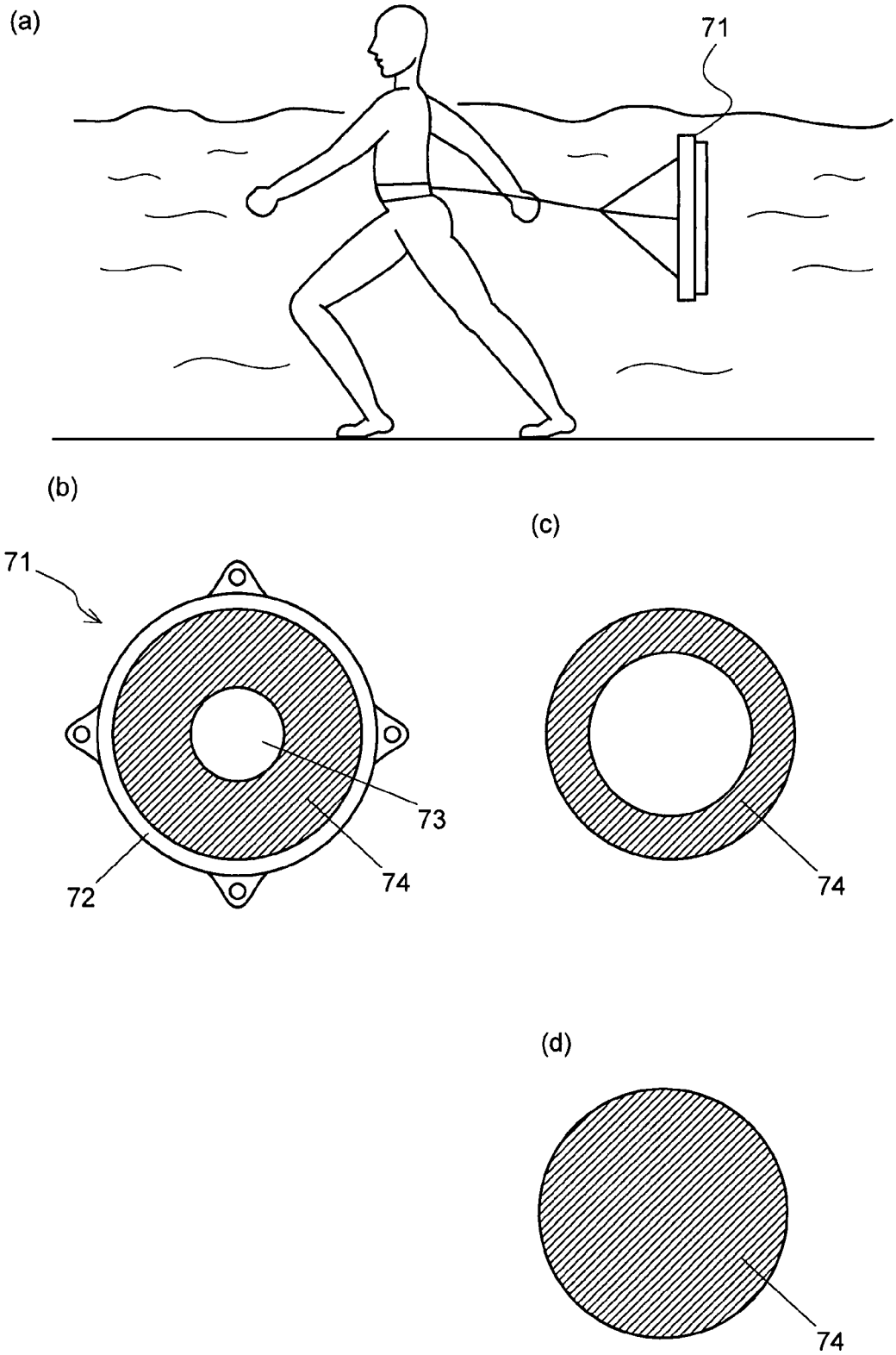
FIG. 7 A side view of an in-water walking training and rehabilitation device in use (a) and an elevation view of the in-water walking training and rehabilitation device (b).

Such in-water training or rehabilitation can be easily performed in a bath as shown in FIG. 7 at home, thus permitting continuous practice of this training or rehabilitation, which offers great training and rehabilitation effect. Specifically, for example, with movement made 15 to 20 times defined as one set, three or four sets of movement are made. The suitable rest time (interval) between the sets is one to two minutes.

The basic idea of the present invention is also applicable to training or rehabilitation of the entire lower body. FIG. 7 shows a condition that walking training is being performed in water with a resistance part 71 with a variable area, as described above, attached to the waist. Adapting the area of this resistance part 71 to be variable, similarly to the above, permits more effectively performing training or rehabilitation in various stages for a short period of time. FIG. 7(*b*) shows one example of the way to vary the area of the resistance part 71. This is in the form that fixes any of resistance plates 74 (FIGS. 7(*b*) and 7(*c*)) respectively having holes 73 of different diameters in a circular frame 72. For the resistance plate 74, a rubber plate, a plastic plate, yacht sailing fabric, or the like can also be used. As the resistance part 71, in addition to this, those described in the in-water training and rehabilitation device for forearm improvement described above can also be directly used.

Figure 8:
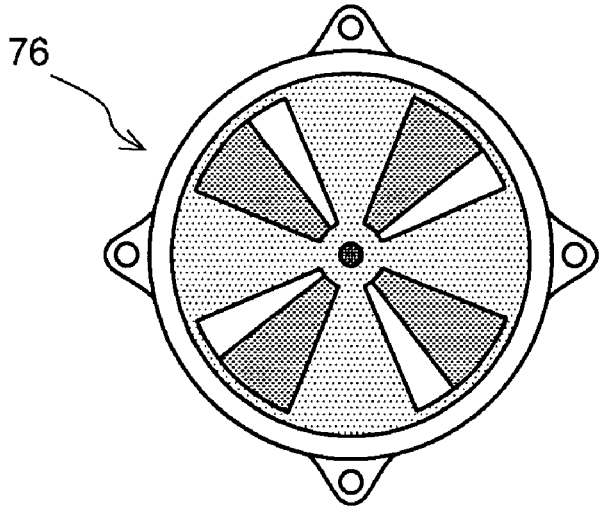
FIG. 8 An elevation view of another in-water walking training and rehabilitation device.

FIG. 8 shows another example 76 of a resistance part with a variable area of the in-water walking training and rehabilitation device.

Figure 9:
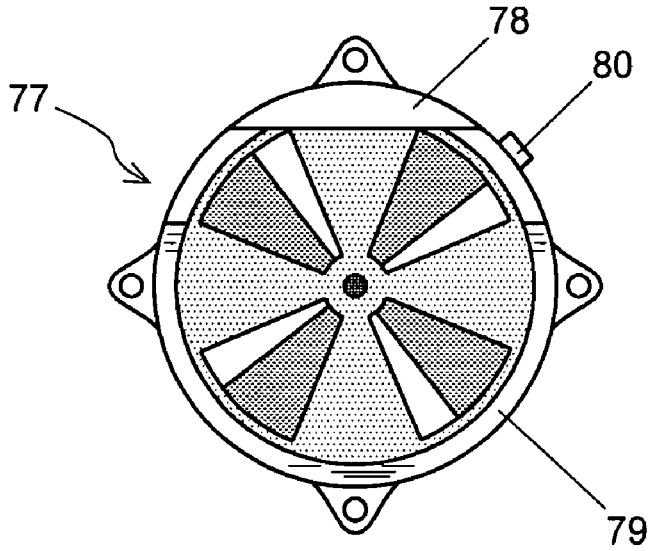
FIG. 9 An elevation view of still another in-water walking training and rehabilitation device.

In the resistance part of this in-water walking training and rehabilitation device, a buoyancy adjustment mechanism can be provided. FIG. 9 shows an example of a resistance part 77 provided with such a mechanism. At the top of the resistance part, a floating part 78 is formed as a space for increasing the buoyancy through introduction of expanded polystyrene or air, and at the periphery of the resistance part, a subsidence part 79 is provided as a space for increasing the weight through introduction of ballast. In the subsidence part 79, a fill port 80 is provided for water introduction (it is convenient to use water in a pool). The arrangement of the floating part 78 at the top and the subsidence part 79 at the bottom in this manner permits the resistance part 77 to be stably oriented vertically at any time. Moreover, the depth of the resistance part 77 in water can be freely adjusted by adjusting the amount of water introduced to the subsidence part 79. Such adjustment of the depth of the resistance part 77 in water can offer an advantage in training or rehabilitation of an arbitrary portion of the lower body.

The invention claimed is:

1. An in-water training and rehabilitation device for training or rehabilitating an objective muscle or muscles of mainly forearms by moving the same in water, the device comprising:

a frame, the frame including a plurality of fixing holes;

a substantially planar resistance part having at least one resistance plate that is attached to the frame, wherein a number of the at least one resistance plate is selectively variable, and wherein a position and an arrangement of the at least one resistance plate is changeable relative to the frame resulting in a plurality of configurations of the resistance part and resulting in the resistance part having a variable area; and a plurality of handles of different kinds, the handles being attachable to and detachable from the frame via the fixing holes, the handles being designed for use with a human hand, and at least one of the handles being selectively fixed to the frame, wherein in at least one configuration, the frame and the resistance part are configured to allow water to pass through a portion of the resistance part where the at least one resistance plate is not attached to the frame and not allow water to pass through a portion of the resistance part where the at least one resistance plate is attached to the frame, an arrangement of the at least one resistance plate is arbitrarily set by a user, an arrangement of one of the plurality of handles is arbitrarily set by the user, and when selectively fixed to the frame, the plurality of handles of different kinds extend outward from the frame along a plane parallel to a plane in which the resistance part extends.

2. The in-water training and rehabilitation device according to claim 1, wherein the area of the resistance part is variable asymmetrically with respect to one of the handles.

3. The in-water training and rehabilitation device according to claim 1, wherein the plurality of handles includes at least two among a bar handle, a grip handle, and a palm-fixing handle.

4. The in-water training and rehabilitation device according to claim 2, wherein the plurality of handles includes at least two among a bar handle, a grip handle, and a palm-fixing handle.

5. The in-water training and rehabilitation device according to claim 1, the device further comprising:

a plurality of resistance plates, wherein the frame comprises a plurality of holes, and each resistance plate is structured to be inserted in each hole.

6. The in-water training and rehabilitation device according to claim 1, wherein the fixing holes are at disposed at two different sides of the frame.

7. The in-water training and rehabilitation device according to claim 1, wherein the fixing holes are disposed in an outer periphery of the frame, the outer periphery facing a direction perpendicular to a plane in which the resistance part extends.

8. The in-water training and rehabilitation device according to claim 1, wherein the at least one resistance plate is attached to the frame such that movement of the at least one resistance plate is prevented during movement of the in-water training device in water.

9. The in-water training and rehabilitation device according to claim 1, wherein a total perimeter of the frame prevents the escape of the at least one resistance plate in any direction parallel to a plane in which the resistance part extends.

10. An in-water training and rehabilitation device for training or rehabilitating an objective muscle or muscles of mainly forearms by moving the same in water, the device comprising:

a frame including a plurality of holes;

a substantially planar resistance part having a plurality of resistance plates, each resistance plate being structured to be inserted in each hole thereby being attached to the frame, wherein a number of the resistance plates is selectively variable, and wherein a position and an arrangement of the resistance plates is changeable relative to the frame resulting in a plurality of configurations of the resistance part and resulting in the resistance part having a variable area; and a plurality of handles of different kinds, the handles being attachable to and detachable from the frame, the handles being designed for use with a human hand, and at least one of the handles being selectively fixed to the frame, wherein in at least one configuration, the frame and the resistance part are configured to allow water to pass through a portion of the resistance part where the at least one resistance plate is not attached to the frame and not allow water to pass through a portion of the resistance part where the at least one resistance plate is attached to the frame, an arrangement of the at least one resistance plate is arbitrarily set by a user, an arrangement of one of the plurality of handles is arbitrarily set by the user, and when selectively fixed to the frame, the plurality of handles of different kinds extend outward from the frame along a plane parallel to a plane in which the resistance part extends.

11. The in-water training and rehabilitation device according to claim 10, wherein:

the frame includes a plurality of fixing holes; and the handles are attachable to and detachable from the frame via the fixing holes.

12. The in-water training and rehabilitation device according to claim 10, wherein the fixing holes are disposed at two different sides of the frame.

13. The in-water training and rehabilitation device according to claim 10, wherein the at least one resistance plate is attached to the frame such that movement of the at least one resistance plate is prevented during movement of the in-water training device in water.

14. The in-water training and rehabilitation device according to claim 10, wherein a total perimeter of the frame prevents the escape of the at least one resistance plate in any direction parallel to a plane in which the resistance part extends.

* * * * *